US009878889B2

(12) United States Patent
Watson et al.

(10) Patent No.: US 9,878,889 B2
(45) Date of Patent: Jan. 30, 2018

(54) MAST LIFT USING MULTI-STAGE MAST MODULE

(75) Inventors: Jason James Watson, Matraville (AU); Geoffrey George Campbell, Kensington (AU)

(73) Assignee: JLG INDUSTRIES, INC., Hagerstown, MD (US)

( * ) Notice: Subject to any disclaimer, the term of this patent is extended or adjusted under 35 U.S.C. 154(b) by 110 days.

(21) Appl. No.: 13/816,425

(22) PCT Filed: Aug. 17, 2011

(86) PCT No.: PCT/US2011/048053

§ 371 (c)(1),
(2), (4) Date: Feb. 11, 2013

(87) PCT Pub. No.: WO2012/024378

PCT Pub. Date: Feb. 23, 2012

(65) Prior Publication Data

US 2013/0161128 A1 Jun. 27, 2013

Related U.S. Application Data

(60) Provisional application No. 61/374,368, filed on Aug. 17, 2010.

(51) Int. Cl.
*B66F 11/04* (2006.01)
*E04G 1/22* (2006.01)

(52) U.S. Cl.
CPC ..... *B66F 11/046* (2013.01); *B66F 11/04* (2013.01); *E04G 1/22* (2013.01)

(58) Field of Classification Search
CPC ..... B25J 18/025; A47B 9/04
USPC ..... 182/2.11, 141, 148
See application file for complete search history.

(56) References Cited

U.S. PATENT DOCUMENTS

| | | | | |
|---|---|---|---|---|
| 1,342,828 | A | 12/1915 | Seymour | |
| 3,404,752 | A | 10/1968 | Deines | |
| 3,871,478 | A * | 3/1975 | Bushnell, Jr. | 182/69.4 |
| 3,876,039 | A | 4/1975 | Bushnell, Jr. | |
| RE28,455 | E | 7/1975 | Denier et al. | |

(Continued)

FOREIGN PATENT DOCUMENTS

| | | |
|---|---|---|
| DE | 85 05 465 | 4/1985 |
| EP | 0 096 208 | 12/1983 |

(Continued)

OTHER PUBLICATIONS

Australian Examination Report No. 1 dated May 2, 2013 issued in Australian Patent Application No. 2011205172, 4 pp.

(Continued)

*Primary Examiner* — Colleen M Chavchavadze
(74) *Attorney, Agent, or Firm* — Nixon & Vanderhye P.C.

(57) ABSTRACT

A multi-stage mast module is cooperable with a mast lift. The mast lift includes a base supporting the multi-stage mast module and a platform coupled with the multi-stage mast module. The multi-stage mast module includes a mast unit including a plurality of telescoping mast sections, and a multi-stage drive connected between the telescoping mast sections of the mast unit. Gas springs are connected between the telescoping mast sections of the mast unit. The gas springs act between the adjacent ones of the telescoping mast sections.

14 Claims, 6 Drawing Sheets

(56) References Cited

U.S. PATENT DOCUMENTS

| | | | | |
|---|---|---|---|---|
| 4,258,825 | A | 3/1981 | Collins | |
| 4,575,976 | A * | 3/1986 | McDermott et al. | 52/118 |
| 4,875,555 | A | 10/1989 | Johansson et al. | |
| 5,425,433 | A * | 6/1995 | Huber | 187/225 |
| 5,427,197 | A * | 6/1995 | Waters | 182/2.9 |
| 5,624,046 | A | 4/1997 | Zimmermann | |
| 5,636,705 | A | 6/1997 | St-Germain | |
| 5,755,306 | A * | 5/1998 | Kraemer et al. | 182/148 |
| 5,850,892 | A | 12/1998 | Citron et al. | |
| 5,937,699 | A * | 8/1999 | Garrec | B25J 18/025 74/89.35 |
| 6,026,970 | A * | 2/2000 | Sturm, Jr. | B66C 23/706 212/348 |
| 6,041,491 | A | 3/2000 | Ishikawa et al. | |
| 6,174,124 | B1 | 1/2001 | Haverfield et al. | |
| 6,206,059 | B1 | 3/2001 | Maakad et al. | |
| 6,299,336 | B1 * | 10/2001 | Hulse | 362/526 |
| 6,382,039 | B1 * | 5/2002 | Choi | B25J 18/025 108/147.19 |
| 6,401,864 | B1 * | 6/2002 | Stringer et al. | 182/148 |
| 6,435,048 | B1 * | 8/2002 | Zimmerman | A47B 9/04 108/147 |
| 6,471,004 | B2 | 10/2002 | Stringer et al. | |
| D570,071 | S | 5/2008 | Campbell et al. | |
| 7,458,562 | B1 * | 12/2008 | Chen | B66F 3/10 254/103 |
| 7,497,140 | B2 | 3/2009 | Blackwelder et al. | |
| 7,614,459 | B2 | 11/2009 | Campbell et al. | |
| 7,712,389 | B2 * | 5/2010 | Wang | F16H 25/20 254/102 |
| 7,762,532 | B2 | 7/2010 | Campbell et al. | |
| 7,766,750 | B2 | 8/2010 | Campbell et al. | |
| 7,896,366 | B2 | 3/2011 | Campbell et al. | |
| 8,292,039 | B2 | 10/2012 | Campbell et al. | |
| 2007/0125599 | A1 | 6/2007 | Campbell et al. | |
| 2010/0294594 | A1 | 11/2010 | Campbell et al. | |
| 2012/0043158 | A1 | 2/2012 | Campbell et al. | |
| 2015/0285430 | A1 * | 10/2015 | Wang | A47B 9/04 248/188.5 |

FOREIGN PATENT DOCUMENTS

| | | |
|---|---|---|
| EP | 0 273 888 | 7/1988 |
| JP | 57-46577 | 9/1955 |
| JP | 49-104354 | 10/1974 |
| JP | 63-168160 | 7/1988 |
| JP | 2-4900 | 1/1990 |
| JP | 2-159404 | 6/1990 |
| JP | 2-107337 | 8/1990 |
| JP | 3-100289 | 10/1991 |
| JP | 4-366050 | 12/1992 |
| JP | 5-69079 | 9/1993 |
| JP | 6-340398 | 12/1994 |
| JP | 9-151088 | 6/1997 |
| JP | 10-36087 | 2/1998 |
| JP | 2000-153995 | 6/2000 |
| JP | 3166610 | 3/2001 |
| JP | 2003-327393 | 11/2003 |
| JP | 2006-264797 | 10/2006 |
| JP | 2007-039227 | 2/2007 |

OTHER PUBLICATIONS

Japanese Office Action dated Feb. 14, 2013 issued in Japanese Patent Application No. 2011-178048 and English translation, 6 pp.
Japanese Office Action dated Dec. 3, 2013 issued in Japanese Patent Application No. 2011-178048 and English Translation, 4 pp.
Japanese Office Action dated Jan. 6, 2015 issued in Japanese Patent Application No. 2013-524956 and English translation, 7 pp.
U.S. Office Action dated Nov. 18, 2015 issued in U.S. Appl. No. 14/338,906, 18 pp.
European Examination Report dated Jul. 20, 2015 issued in European Patent Application No. 11177697.7, 5 pp.
Japanese Office Action dated. Feb. 14, 2013 issued in Japanese Patent Application No. 2011-178048 and English translation, 6 pp.
Japanese Office Action dated Feb. 25, 2014 issued in Japanese Patent Application No. 2013-524956 and English Translation, 10 pp.
Canadian Office Action dated May 22, 2014 issued in Canadian Patent Application No. 2,748,076, 3 pp.

* cited by examiner

MAST LIFT USING MULTI-STAGE MAST MODULE

This application is the U.S. national phase of International Application No. PCT/US2011/048053 filed 17 Aug. 2011 which designated the U.S. and claims priority to U.S. Provisional Application No. 61/374,368 filed 17 Aug. 2010, the entire contents of each of which are hereby incorporated by reference.

BACKGROUND OF THE INVENTION

The present invention relates to a personnel lift and, more particularly, to a portable lift machine including a work platform raised and lowered by a lifting system. The Lift-Pod® system by JLG Industries, Inc. has been described in U.S. patent application Ser. No. 10/594,666, U.S. patent application Ser. No. 11/581,785, U.S. patent application Ser. No. 12/190,217, U.S. patent application Ser. No. 12/293,759, U.S. patent application Ser. No. 13/191,676, U.S. Pat. No. D570,071, U.S. Pat. No. 7,614,459, U.S. Pat. No. 7,762,532, and U.S. Pat. No. 7,766,750. See also www.Lift-Pod.com. The contents of the referenced documents are incorporated by reference.

The ladder concept is several thousand years old. Existing ladders, however, can be cumbersome and difficult to maneuver. Additionally, conventional ladders can be unstable particularly on uneven ground, and a work area is limited to the user's reach.

Ladder companies are reluctant to develop powered mechanical products. It would be desirable, however, to develop a personnel lift that achieves many of the advantages of a ladder, e.g., can be set up and used by a single operator, lightweight, etc., while providing for greater stability and a larger working area in a portable powered machine.

Mast climbing platforms are known and typically include a mast that can be free-standing or supported by a wall or other support structure. However, existing mast climbers have minimum SWL loads of 1000 lbs and are not portable or operable by a single user due at least to their size. Vertical mast products and aerial work platforms include a moving platform and generally are also typically too large for portability and are very far from the many advantages provided by a ladder in terms of portability, low cost and ease of use.

To achieve portability, a light weight, reliable lift system mechanism is desirable to provide the functionality expected of a device which lifts personnel.

SUMMARY OF THE INVENTION

The invention generally relates to a mast lift with a higher reach (e.g., a 14 foot platform height) that breaks down into portable modules (i.e., to be carried by a single person) and is driven using cordless drill technology. This product type can provide solutions for many applications which are currently not serviced by existing aerial work platform (AWP) technology. An example of such an application would be double height ceilings in homes, which existing AWP's cannot be used to access due to size, access and floor bearings constraints. Also, the common methods to access these areas are to use large ladders and scaffolding, which are generally cumbersome and dangerous. Target applications for the present design would also include school gymnasiums, hotel foyers, and factory lighting.

In an exemplary embodiment, a multi-stage mast module is cooperable with a mast lift. The mast lift includes a base supporting the multi-stage mast module and a platform coupled with the multi-stage mast module. The multi-stage mast module includes a mast unit including a plurality of telescoping mast sections, and a multi-stage drive connected between the telescoping mast sections of the mast unit. The multi-stage drive includes acme threads respectively operatively positioned between adjacent ones of the telescoping mast sections. The acme threads are driven to displace the telescoping mast sections between a retracted position and an extended position. Gas springs are connected between the telescoping mast sections of the mast unit. The gas springs act between the adjacent ones of the telescoping mast sections.

In one embodiment, the multi-stage drive comprises telescoping acme threads. Alternatively, the multi-stage drive may include offset acme threads. Preferably, the gas springs are oriented to bias the telescoping mast sections toward the extended position.

The multi-stage mast module may additionally include supporting structure shaped and positioned to support a second multi-stage mast module. The module may also include connecting structure selectively coupleable with supporting structure of a second multi-stage mast module or the base.

In one arrangement, the mast unit includes a bottom mast section, a middle mast section movable relative to the bottom mast section, and a top mast section movable relative to the middle mast section. In this context, the module may additionally include a first acme thread and a second acme thread. The first acme thread has one end rotatably secured to one of the bottom mast section and the middle mast section, and an opposite end engaging a bottom nut fixed to the other of the bottom mast section and the middle mast section. The second acme thread has one end rotatably secured to one of the middle mast section and the top mast section, and an opposite end engaging a top nut fixed to the other of the middle mast section and the top mast section. Rotating the first acme thread relative to the bottom nut serves to displace the middle mast section relative to the bottom mast section, and rotating the second acme thread relative to the top nut serves to displace the top mast section relative to the middle mast section.

The module may still additionally include a first gas spring and a second gas spring, where the first gas spring acts between the bottom mast section and the middle mast section, and the second gas spring acts between the middle mast section and the top mast section. Preferably, the first gas spring and the second gas spring operate in series.

One of the first acme thread and the second acme thread may include a hollow tube that receives the other of the first acme thread and the second acme thread, where a respective one of the bottom nut and the top nut is disposed within the hollow tube. In an alternative construction, the first acme thread may be offset to one side of the second acme thread, where the multi-stage drive may further include connecting structure, such as a toothed belt drive and a gear, that rotationally couples the first acme thread and the second acme thread such that torque from the first acme thread is translated to the second acme thread and torque from the second acme thread is translated to the first acme thread.

In another exemplary embodiment, a mast lift includes a base and a first multi-stage mast module securable to the base. The first multi-stage mast module includes a mast unit including a plurality of telescoping mast sections, and a multi-stage drive connected between the telescoping mast sections of the mast unit. The multi-stage drive includes acme threads respectively operatively positioned between adjacent ones of the telescoping mast sections. The acme threads are driven to displace the telescoping mast sections between a retracted position and an extended position. The first multi-stage mast module also includes gas springs connected between the telescoping mast sections of the mast unit. The gas springs act between the adjacent ones of the telescoping mast sections. The mast lift also includes a platform securable to the first multi-stage mast module.

The mast lift may additionally include a second multi-stage mast module selectively coupleable between the first multi-stage mast module and the base. In this context, the base may include a base stump on which either of the first multi-stage mast module or the second multi-stage mast module is removably mountable, where the second multi-stage mast module comprises a module stump on which the first multi-stage mast module is removably mountable.

In yet another exemplary embodiment, a modular portable mast lift includes a base; a first multi-stage mast module securable to the base, the first multi-stage mast module including a first plurality of telescoping mast sections; a second multi-stage mast module selectively coupleable between the first multi-stage mast module and the base, the second multi-stage mast module including a second plurality of telescoping mast sections; and a platform securable to the first multi-stage mast module. The first and second multi-stage mast modules may each include a lift assembly drivable via a hand-held power drill, and gas springs connected between the telescoping mast sections, where the gas springs act between adjacent ones of the telescoping mast sections.

In still another exemplary embodiment, a multi-stage mast module is cooperable with a mast lift. The mast lift includes a base supporting the multi-stage mast module and a platform coupled with the multi-stage mast module. The multi-stage mast module includes a mast unit including a plurality of telescoping mast sections, and a multi-stage drive connected between the telescoping mast sections of the mast unit. Gas springs are connected between the telescoping mast sections of the mast unit. The gas springs act between the adjacent ones of the telescoping mast sections.

BRIEF DESCRIPTION OF THE DRAWINGS

These and other aspects and advantages of the present invention will be described with reference to the accompanying drawings, in which.

DETAILED DESCRIPTION OF THE DRAWINGS

Figure 1:
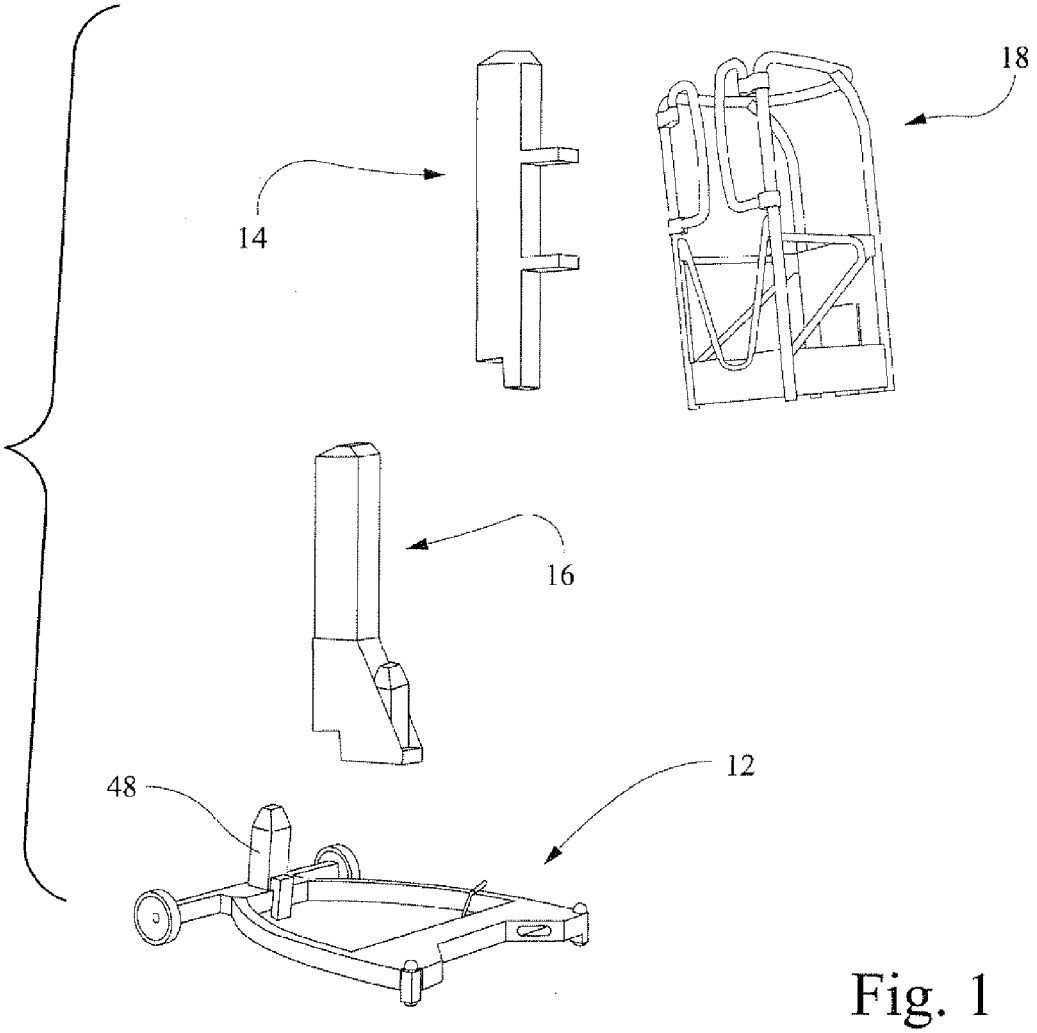
FIG. 1 shows the modular components of the mast lift.
Figure 2:
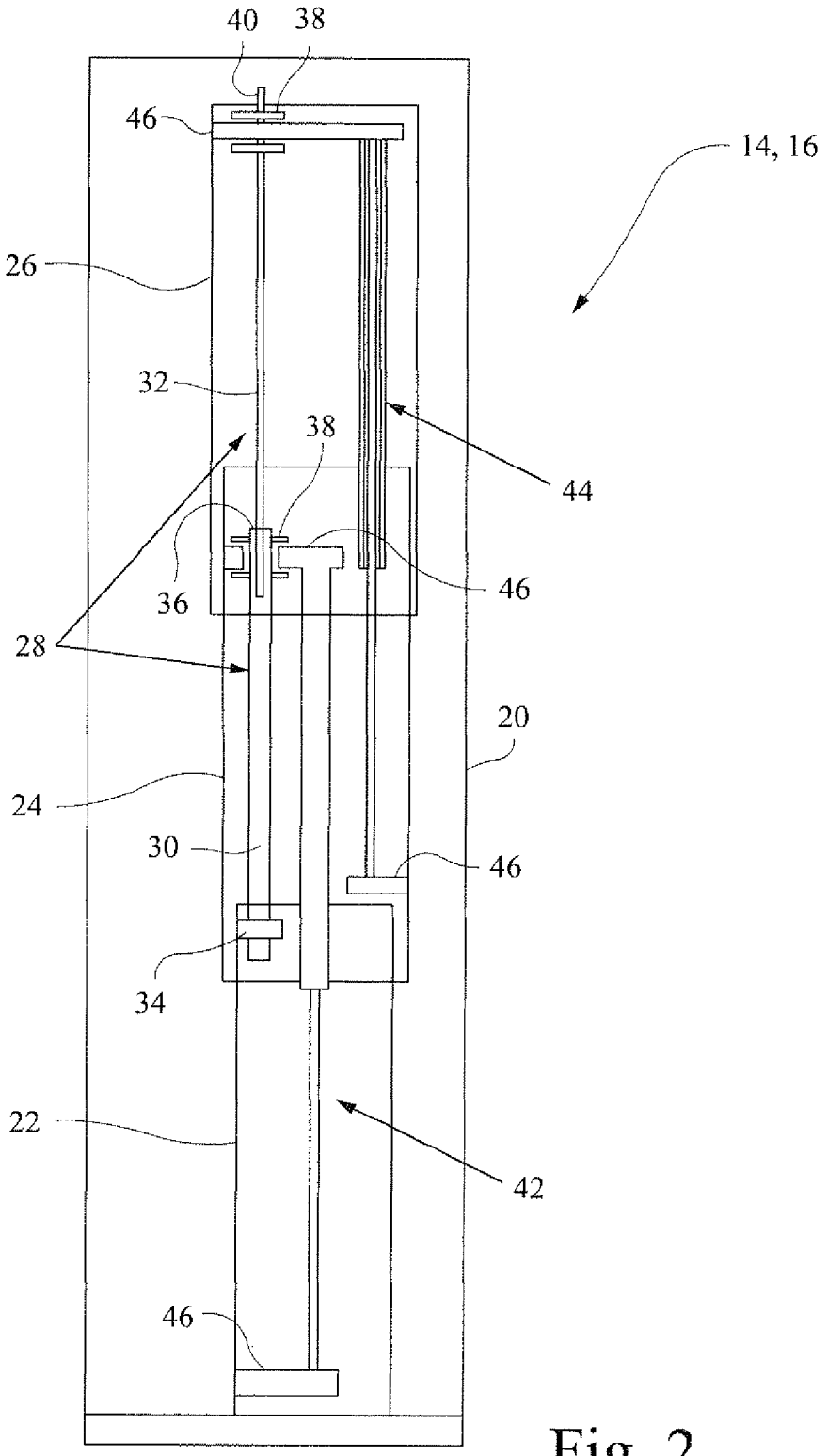
FIG. 2 is a sectional view of an exemplary mast module.

The mast lift according to preferred embodiments is constructed of modular components to provide versatility and to facilitate transportability. With reference to FIG. 1, the mast lift includes a base 12, a first mast module 14, a second mast module 16 and a platform 18. With reference to FIG. 2, each mast module 14, 16 is composed of a mast unit 20 including a plurality of telescoping mast sections. In particular, the mast unit 20 includes a bottom mast section 22, a middle mast section 24 that is movable relative to the bottom mast section 22, and a top mast section 26 that is movable relative to the middle mast section 24. Although three mast sections 22, 24, 26 are shown, the mast unit 20 may include more or fewer sections.

The mast modules 14, 16 are provided with a multi-stage drive 28 that serves to displace the telescoping mast sections 22, 24, 26 between a retracted position and an extended position. As shown, the multi-stage drive 28 may include acme threads or drive screws 30, 32 that are respectively operatively positioned between adjacent ones of the telescoping mast sections (22, 24 and 24, 26, respectively). The acme threads/drive screws are threaded rods or shafts.

In use, each acme thread 30, 32 has one end rotatably fixed to one of the mast sections and an opposite end secured in a nut 34, 36 fixed to an adjacent mast section. Rotating the acme threads 30, 32 relative to the nuts 34, 36 serves to axially displace the acme threads 30, 32 relative to the nuts 34, 36, thereby displacing the middle and upper mast sections 24, 26 relative to each other and relative to the bottom mast section 22.

In the embodiment shown in FIG. 2, the multi-stage drive 28 is constructed as a two-stage telescopic acme drive. A first stage of the drive is the acme thread 32 attached axially to the top mast section 26. The first stage acme thread 32 is rotatably fixed to the top mast section 26 via a suitable connector 38. As shown, a portion 40 of the first stage acme thread 32 extends outside of the top mast section 26. The second stage acme thread 30 is comprised of a hollow tube having an inner diameter sized to receive the first stage acme thread 32. The hollow tube is provided with a thread on its outer wall. The first stage acme thread 32 is received within the hollow tube in the nut 36, which is secured within the hollow tube of the second stage acme thread 30. Rotation of first stage acme thread 32 thus serves to displace the first stage acme thread 32 and thereby the top mast section 26 relative to the nut 36 and the middle mast section 24.

The second stage acme thread 30, which is the hollow tube, is rotatably fixed via a suitable connector 38 or the like to the middle mast section 24. The exterior threads of the second stage acme thread 30 are received in the nut 34, which is fixed to the bottom mast section 22. Rotation of the second stage acme thread 30 in the nut 34 thus serves to axially displace the middle and top mast sections 24, 26 relative to the bottom mast section 22.

The mast modules 14, 16 are displaceable between extended and retracted positions by attaching a hand-held power drill or similar power device to the portion 40 of the first stage acme thread 32. Theoretically, the drive source could be applied to the second stage acme thread 30 from below. Due to the diameter ratio, the first stage acme thread 32 will be driven first as it will have a smaller diameter, and consequently a lower coefficient of friction. As such, the top mast section 26 will extend up from the middle and bottom mast sections 24, 22 below it. When the first stage acme thread 32 reaches its end of travel, the second stage (hollow tube) acme thread 30 will pick up. The second stage acme thread 30 has a higher coefficient of friction due to its larger diameter. Continued rotation of the second stage acme thread 30 serves to displace the middle mast section 24 and the top mast section 26 relative to the bottom mast section 22.

As would be appreciated by those of ordinary skill in the art, additional stages may be used to provide further reach and expansion capabilities of the mast modules 14, 16. A third stage may similarly comprise a hollow tube acme thread internally securing a nut for receiving the second stage acme thread 30 and be provided with external threads displaceable in yet another nut secured to yet another mast section. Power requirements for additional stages would increase with each stage as the acme thread diameter increases, and the use of a cordless hand-held power drill will have limitations.

With continued reference to FIG. 2, the mast modules 14, 16 additionally include gas springs 42, 44 connected between the telescoping mast sections 22, 24, 26 of the mast unit 20. The gas springs 42, 44 act between adjacent ones of the telescoping mast sections 22, 24, 26. The gas springs 42, 44 operate in series and are configured to bias the telescoping mast sections 22, 24, 26 toward the extended position. A first gas spring 42 acts between the bottom mast section 22 and the middle mast section 24. One end of the gas spring 42 is fixed to the bottom mast section 22 via a suitable connector 46. An opposite end of the gas spring 42 is fixed to the middle mast section 24 by a suitable connector 46. The second gas spring 44 acts between the middle mast section 24 and the top mast section 26, ends of which are respectively secured to the middle mast section 24 and the top mast section 26 via connectors 46.

The gas springs 42, 44 are preferably pneumatic gas springs and are positioned in series to allow both drives to operate within power limits of a hand-held cordless drill. The gas spring rated forces are selected to provide an optimal balance for the intended operating loads of the machine. The gas spring rated capacities are determined in consideration of power requirements for both lifting and lowering of the machine in addition to minimum and maximum capacities.

Figure 3:
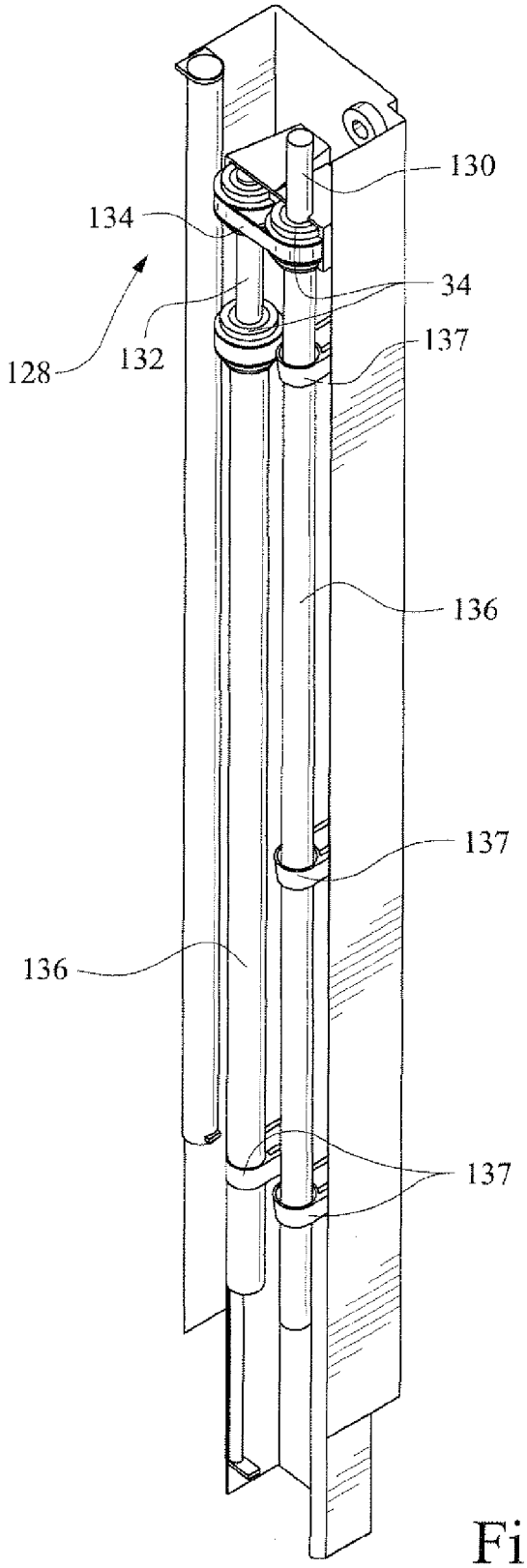
FIG. 3 is a perspective view of a portion of an alternative mast module including acme threads in a side-by-side configuration.
Figure 4:
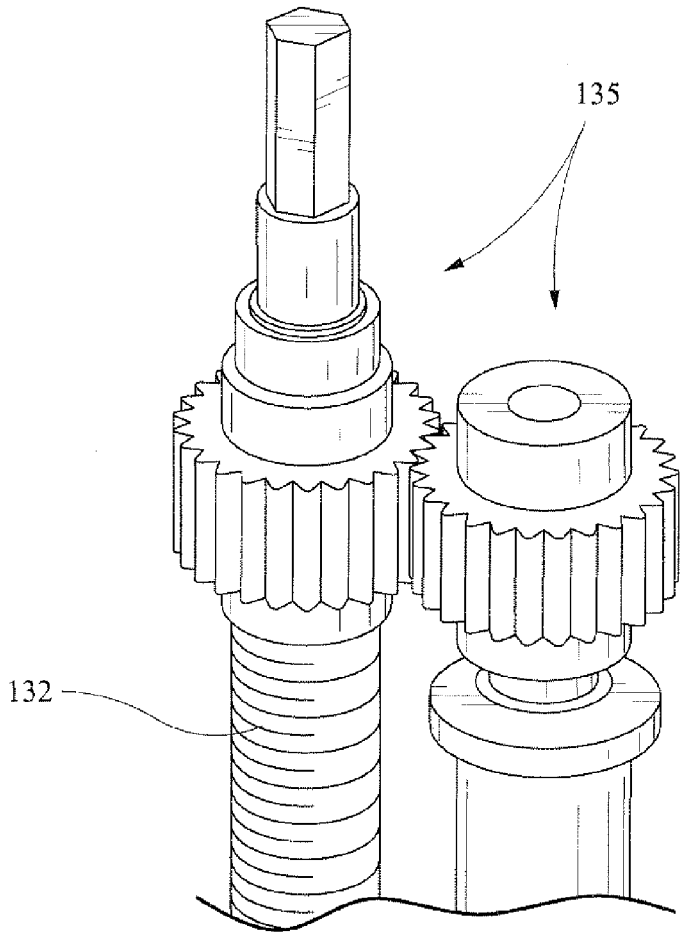
FIG. 4 shows an alternative coupling between the side-by-side acme threads.

As an alternative to the two-stage telescopic acme drive 28, the acme threads can be arranged in an offset configuration. FIG. 3 shows a section of the two-stage offset acme drive 128 with the mast module in its retracted position. The offset acme drive includes a first acme thread/drive screw 130 and a second acme thread/drive screw 132. The coupling of each thread/drive screw to the respective telescoping mast sections is similar to the two-stage telescopic acme drive 28. However, instead of the top stage acme thread telescoping in/out of the second stage acme thread, the first stage 130 is offset to one side of the second stage 132. The acme threads 130, 132 are coupled rotationally via a suitable connector 134 to translate torque from the first stage to the second stage. An exemplary connector 134 is shown in FIG. 3 as a toothed belt drive. Any common coupling mechanism can be used such as gears or other belt drives. An exemplary geared coupling 135 is shown in FIG. 4. The offset assembly may also include guide tubes 136 and guides 137 that help control whip of the threads when they are at their longest unsupported length. These guide tubes 136 also serve as grease houses to keep the threads lubricated.

Like the telescopic drive, a hand-held cordless drill or equivalent power system can be attached to the top of the first stage acme thread 130. When the first stage acme thread 130 reaches its full extension, it would then drive the second stage acme thread 132 to reach its full height. Depending on the arrangement of the acme threads 130, 132, the fist and second stages may be extended/retracted simultaneously. As discussed previously, the application of the drive may be applied in several different configurations, including from the bottom of the mast, or possibly from the sides using a helical or worm drive.

It is theoretically viable that the offset acme drive could be used through more stages than those shown in FIG. 3. To do so would require the replication of the coupling from the first drive to the second, e.g., the second acme thread could be coupled to a third stage, and a third to a fourth, etc.

In either the telescopic drive arrangement or the offset drive arrangement, the acme threads may be fixed rotationally while the corresponding nuts are secured for rotation to axially displace the threads relative to the nuts (and thereby extend/retract the mast modules). Still further, the assembly may incorporate both or other alternatives. For example, with the offset drive arrangement, the first stage nut may be coupled to the second stage nut via a toothed belt system or the like. The second stage acme thread may be held stationary, while the second stage nut is rotated to produce movement of the middle section relative to the bottom section. Other configurations will be appreciated, and the invention is not necessarily meant to be limited to a particular arrangement.

Figure 5:
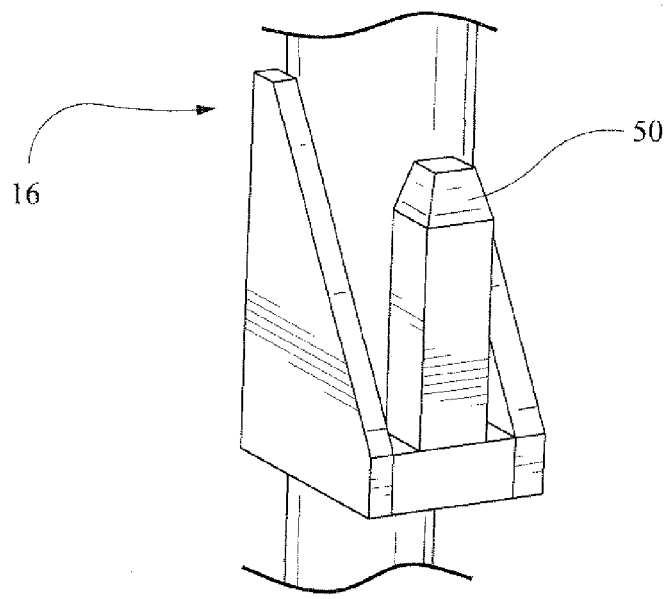
FIG. 5 is a perspective view showing a stump connection for the second mast module.
Figure 6:
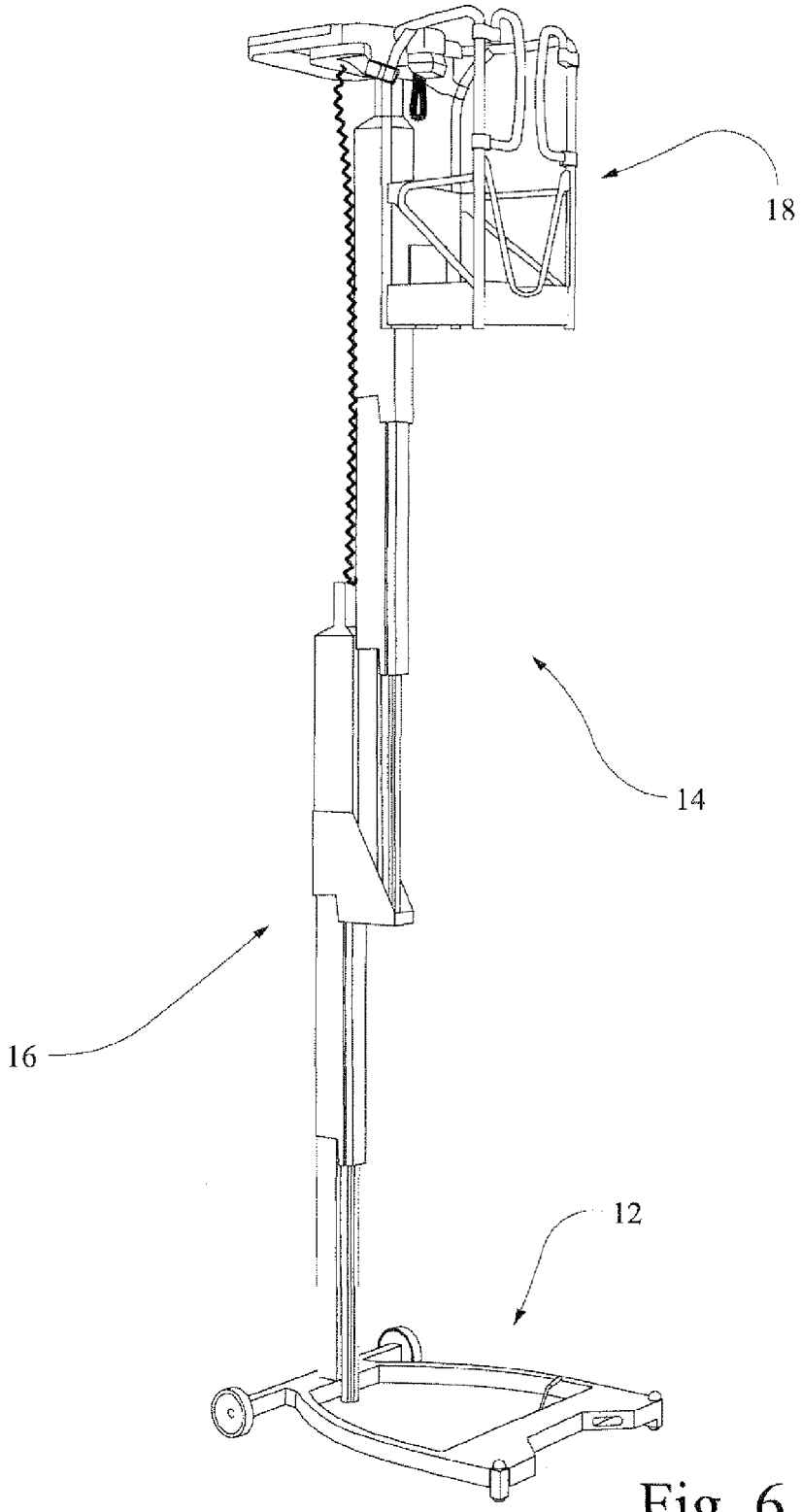
FIG. 6 shows the mast lift using two mast modules to reach a maximum platform height.
Figure 7:
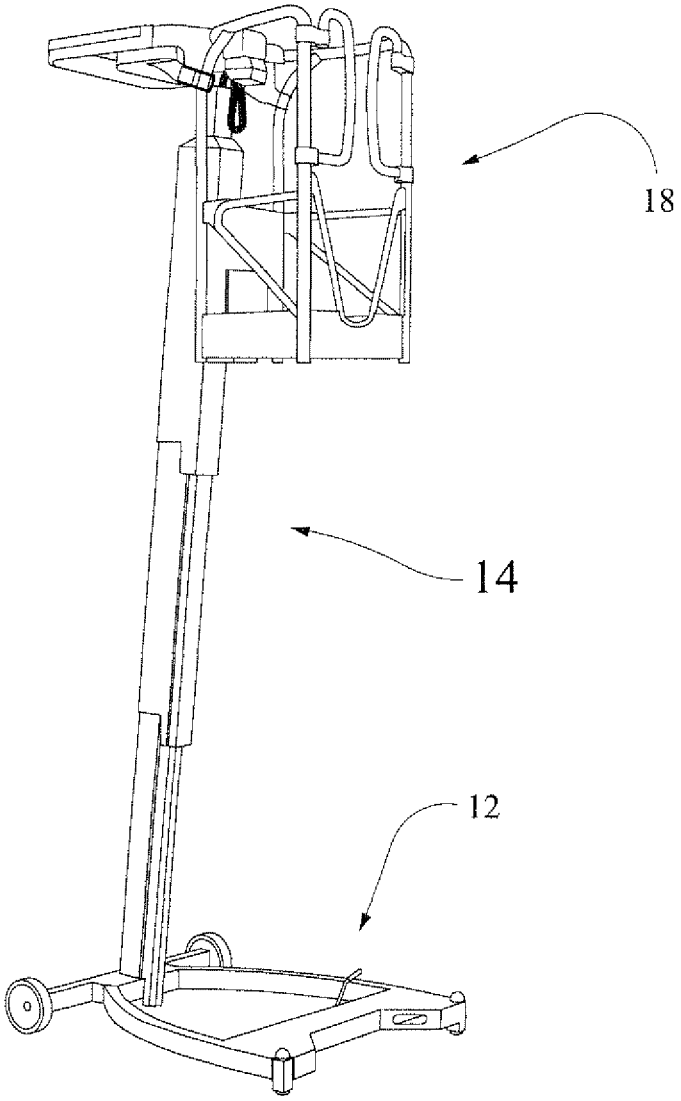
FIG. 7 shows the mast lift using a single mast module.

With reference to FIGS. 1 and 5, the base 12 includes a base stump 48 on which either of the first multi-stage mast module 14 or the second multi-stage mast module 16 is removably mountable. The mast modules 14, 16 may be secured on the base stump 48 via a pin or other suitable locking mechanism. The second mast module 16 includes a similarly constructed module stump 50 on which the first multi-stage mast module 14 is removably mountable. A similar pin or lock mechanism secures the first module 14 on the module stump 50 of the second module 16. With this modular construction, the mast lift can be configured for maximum height using both the first and second mast modules 14, 16 as shown in FIG. 6. In an exemplary construction, using both mast modules 14, 16, the mast lift can reach a platform height of up to 14 feet. With reference to FIG. 7, if a lower platform height is desired, for example, an 8 foot platform height, the first mast module 14 can be secured directly on the base stump 48.

When used in combination as a 14 foot machine, the mast modules 14, 16 are either both driven in sequence using a hand-held cordless drill, or the masts can be driven in parallel using a dedicated power system including two motors, a control box and cordless batteries. The dual motors can either be driven in sequence or simultaneously to drive the machine to full height.

The described technology is a significant progression in the LiftPod® technology and provides many benefits over the previous designs. Some of these benefits include:

- 90% less parts than previous designs
- Telescopic and ⅓ the height in its stowed position—more compact for storage and transportation
- More efficient-initial figures indicate the described technology is up to 50% more efficient than prior machines (resulting in more run time per battery charge)
- Manufacturing cost for the described technology is about 60% less than the prior mast—a significant reduction in COGS (largely due to the part reduction and the simplification of the mechanical system that drives the machine)

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A multi-stage mast module for a mast lift including a base supporting the multi-stage mast module and a platform coupled with the multi-stage mast module, the multi-stage mast module comprising:

a mast unit including three telescoping mast sections;

a multi-stage drive connected between the telescoping mast sections of the mast unit, the multi-stage drive including a first drive member comprising first exterior threads connected between a first telescoping mast section and a second telescoping mast section and a second drive member, separate from the first drive member and comprising second exterior threads, connected between the second telescoping mast section and a third telescoping mast section, wherein the first and second drive members are configured such that both the first drive member and the second drive member are rotated by driving the first drive member and such that the first and second drive members are driven in separate stages to displace the telescoping mast sections between a retracted position and an extended position; and a first gas spring and a second gas spring respectively connected and acting between the first telescoping mast section and the second telescoping mast section and connected and acting between the second telescoping mast section and the third telescoping mast section, wherein the multi-stage mast module is a portable assembly that is selectively connectable to and removable from the mast lift.

2. A multi-stage mast module according to claim 1, wherein the first drive member is oriented in a telescoping configuration with the second drive member.

3. A multi-stage mast module according to claim 1, wherein the gas springs are oriented to bias the telescoping mast sections toward the extended position.

4. A multi-stage mast module according to claim 1, further comprising supporting structure shaped and positioned to support a second multi-stage mast module.

5. A multi-stage mast module according to claim 1, wherein the three telescoping mast sections respectively comprise a bottom mast section, a middle mast section movable relative to the bottom mast section, and a top mast section movable relative to the middle mast section.

6. A multi-stage mast module according to claim 5, the second drive member having one end rotatably secured to one of the bottom mast section and the middle mast section, and an opposite end engaging a bottom nut fixed to the other of the bottom mast section and the middle mast section, and the first drive member having one end rotatably secured to one of the middle mast section and the top mast section, and an opposite end engaging a top nut fixed to the other of the middle mast section and the top mast section, wherein rotating the first drive member relative to the bottom nut serves to displace the middle mast section relative to the bottom mast section, and wherein rotating the second drive member relative to the top nut serves to displace the top mast section relative to the middle mast section.

7. A multi-stage mast module according to claim 6, wherein the first gas spring acts between the bottom mast section and the middle mast section, and the second gas spring acts between the middle mast section and the top mast section.

8. A multi-stage mast module according to claim 7, wherein the first gas spring and the second gas spring operate in series.

9. A multi-stage mast module according to claim 6, wherein one of the first drive member and the second drive member comprises a hollow tube that receives the other of the first drive member and the second drive member, and wherein a respective one of the bottom nut and the top nut is disposed within the hollow tube.

10. A mast lift comprising:

a base;

a first multi-stage mast module securable to the base, the first multi-stage mast module including:

a mast unit including three telescoping mast sections, a multi-stage drive connected between the telescoping mast sections of the mast unit, the multi-stage drive including a first drive member comprising first exterior threads connected between a first telescoping mast section and a second telescoping mast section and a second drive member, separate from the first drive member and comprising second exterior threads, connected between the second telescoping mast section and a third telescoping mast section, wherein the first and second drive members are configured such that both the first drive member and the second drive member are rotated by driving the first drive member and such that the first and second drive members are driven in separate stages to displace the telescoping mast sections between a retracted position and an extended position, and a first gas spring and a second gas spring respectively connected and acting between the first telescoping mast section and the second telescoping mast section and connected and acting between the second telescoping mast section and the third telescoping mast section; and a platform securable to the first multi-stage mast module, wherein the first multi-stage mast module is a portable assembly that is selectively connectable to and removable from the base.

11. A mast lift according to claim 10, wherein the first multi-stage mast module comprises supporting structure shaped and positioned to support a second multi-stage mast module.

12. A mast lift according to claim 10, further comprising a second multi-stage mast module selectively coupleable between the first multi-stage mast module and the base.

13. A mast lift according to claim 12, wherein the base comprises a base stump on which either of the first multi-stage mast module or the second multi-stage mast module is removably mountable, and wherein the second multi-stage mast module comprises a module stump on which the first multi-stage mast module is removably mountable.

14. A modular portable mast lift comprising:

a base;

a first multi-stage mast module independently securable to and removable from the base, the first multi-stage mast module including a first plurality of telescoping mast sections;

a second multi-stage mast module selectively independently coupleable between and removable from the first multi-stage mast module and the base, the second multi-stage mast module including a second plurality of telescoping mast sections; and a platform securable to the first multi-stage mast module, wherein the first multi-stage mast module and the second multi-stage mast module each comprises:

a lift assembly drivable via a hand-held power drill, and gas springs connected between the telescoping mast sections, the gas springs acting in a displacement direction of the telescoping mast sections between adjacent ones of the telescoping mast sections.

* * * * *